US007220160B2

(12) United States Patent
Kiuchi

(10) Patent No.: US 7,220,160 B2
(45) Date of Patent: May 22, 2007

(54) GUN GRIP CONTROLLER

(75) Inventor: Tohru Kiuchi, Kawaguchi (JP)

(73) Assignee: CCP Co., Ltd., Saitama-Ken ( * ) Notice: Subject to any disclaimer, the term of this patent is extended or adjusted under 35 U.S.C. 154(b) by 187 days.

(21) Appl. No.: 10/512,152

(22) PCT Filed: Apr. 23, 2002

(86) PCT No.: PCT/JP02/04046

§ 371 (c)(1),
(2), (4) Date: Oct. 22, 2004

(87) PCT Pub. No.: WO03/090891

PCT Pub. Date: Nov. 6, 2003

(65) Prior Publication Data

US 2005/0181702 A1 Aug. 18, 2005

(51) Int. Cl.
*A63H 30/00* (2006.01)

(52) U.S. Cl. ..... 446/454; 446/456; 341/176

(58) Field of Classification Search ..... 446/454, 446/456, 487, 438, 491; 463/36–38, 47; D21/566, 324, 329; 341/176
See application file for complete search history.

(56) References Cited

U.S. PATENT DOCUMENTS 4,977,306 A * 12/1990 Kosaka et al. ..... 392/380
5,158,495 A * 10/1992 Yonezawa ..... 446/456
5,884,008 A * 3/1999 Goldberg ..... 392/385
6,419,545 B1 * 7/2002 Motosko ..... 446/267
D503,439 S * 3/2005 Galletti ..... D21/566
7,029,363 B2 * 4/2006 Ogihara ..... 446/454
2003/0228916 A1 * 12/2003 Simeray ..... 463/62
2005/0168373 A1 * 8/2005 Mukaida ..... 341/176

FOREIGN PATENT DOCUMENTS

JP 6-54962 3/1994
JP 3069416 3/2000
JP 2001-145513 5/2001

OTHER PUBLICATIONS

DigiQ, Shukan Fami Tsu, Oct. 19, 2001, vol. 16, No. 44, p. 176.

* cited by examiner

*Primary Examiner*—Robert Olszewski
*Assistant Examiner*—Alex F. R. P. Rada, II
(74) *Attorney, Agent, or Firm*—Wenderoth, Lind & Ponack, L.L.P.

(57) ABSTRACT

A gun grip controller includes a rod-shaped controller body having a trigger-shaped lever and a steering dial or the like, for controlling a model car or the like, and a grip provided to protrude from the controller body. The grip is arranged so as to be rotatably attached to the controller body and also adapted so as to allow an occupation of both a protrusive position where the grip protrudes from the controller body in a direction crossing the longitudinal direction of the controller body, and a folded position where the grip is folded along the longitudinal direction of the controller body and adjacent to the outside of the controller body. Therefore, it is possible for the controller to occupy a compact configuration for packing and carrying purposes, in spite of its "gun-grip" configuration.

8 Claims, 2 Drawing Sheets

GUN GRIP CONTROLLER

BACKGROUND OF THE INVENTION

1. Field of the Invention

This invention relates to a gun grip controller used for radio control or the like.

2. Description of the Related Art

Generally, a radio-controlled toy includes a controlled body, such as a controlled model car, and a controller for controlling the controlled body.

For this controller, heretofore, there is known a controller that includes a controller body to be held by both hands of an operator, and switches, sticks, etc. to be manipulated by respective fingers of the operator's hands.

Besides this type of controller, a controller in the form of a gun grip has been used in recent years.

In this gun grip controller, a controller body corresponding to a pistol barrel and a grip corresponding to a pistol grip are constructed in a substantial L-shaped or T-shaped manner, while the controller body is provided with switches, dials, etc. and also provided, at a connection between the grip and the controller body, with a trigger-shaped lever or the like. In manipulation, an operator generally manipulates the trigger-shaped lever by an operator's index finger and further manipulates the switches, the dials, the sticks, etc. on the controller body by an operator's right hand while gripping the grip by an operator's left hand, In the gun grip controller like this, however, it requires a large space for its package and becomes voluminous when carrying the controller because the grip and the controller body are generally in the form of L or T.

In view of solving the above problem, an object of the present invention is to provide a gun grip controller capable of realizing a compact configuration when packed for carrying, in spite of its "gun-grip" configuration.

SUMMARY OF THE INVENTION

The invention is characterized by a gun grip controller comprising: a controller body having a manipulating part for controlling an object to be controlled, the control body being shaped like a rod substantially; and a grip arranged to project from the controller body, wherein the grip is arranged so as to be rotatable to the controller body and also adapted so as to allow an occupation of both a protrusive position where the grip protrudes from the controller in a direction crossing the longitudinal direction of the controller body and a folded position where the grip is folded to extend in a direction along the longitudinal direction of the controller body so as to occupy a position adjacent to the controller body and outside of the controller body, and wherein the grip is provided with a storage recess for accommodating a trigger shaped manipulating part at the folded position.

Another aspect of the invention is characterized in that the controller body has a trigger-shaped manipulating part at a connection part of the controller body with the grip, and the grip is provided with a storage recess for accommodating the trigger-shaped manipulating part at the folded position. Further, the storage recess is provided, at an opening thereof, with a door that is arranged in an open position to accommodate the trigger-shaped manipulating part at the folded position of the grip, and the door is arranged in a closed position when the grip is in a protrusive position.

An additional aspect of the invention is characterized in that the door is formed so as to be a double door.

In the invention the grip is arranged so as to be rotatably attached to the controller body and also adapted so as to allow an occupation of both the protrusive position where the grip protrudes from the controller in a direction crossing the longitudinal direction of the controller body and the folded position where the grip is folded in a direction along the longitudinal direction of the controller body, it is possible to position the grip in the folded position as occasion demands and therefore, it is possible to decrease the size of the controller remarkably in spite of its "gun-grip" configuration.

Furthermore, the controller body has the trigger-shaped manipulating part at the connection part of the controller body with the grip, and the grip is provided with the storage recess for accommodating the trigger-shaped manipulating part at the folded position. Additionally, the storage recess is provided, at its opening, with the door in the form of a double door that is arranged in its open position to accommodate the trigger-shaped manipulating part at the folded position of the grip and that is arranged in its closed position at the protrusive position of the grip. Thus, at the folded position, the door is forced to open by the trigger-shaped manipulating part, so that the trigger-shaped manipulating part is accommodated in the storage recess. While, at the protrusive position, when the trigger-shaped manipulating part retreats from the storage recess, the door automatically closes due to the urging forces of springs, etc. Therefore, it is possible to prevent dust etc. from invading the storage recess and also possible to improve an operator's feeling in gripping the controller.

DETAILED DESCRIPTION OF THE INVENTION

Figure 1:
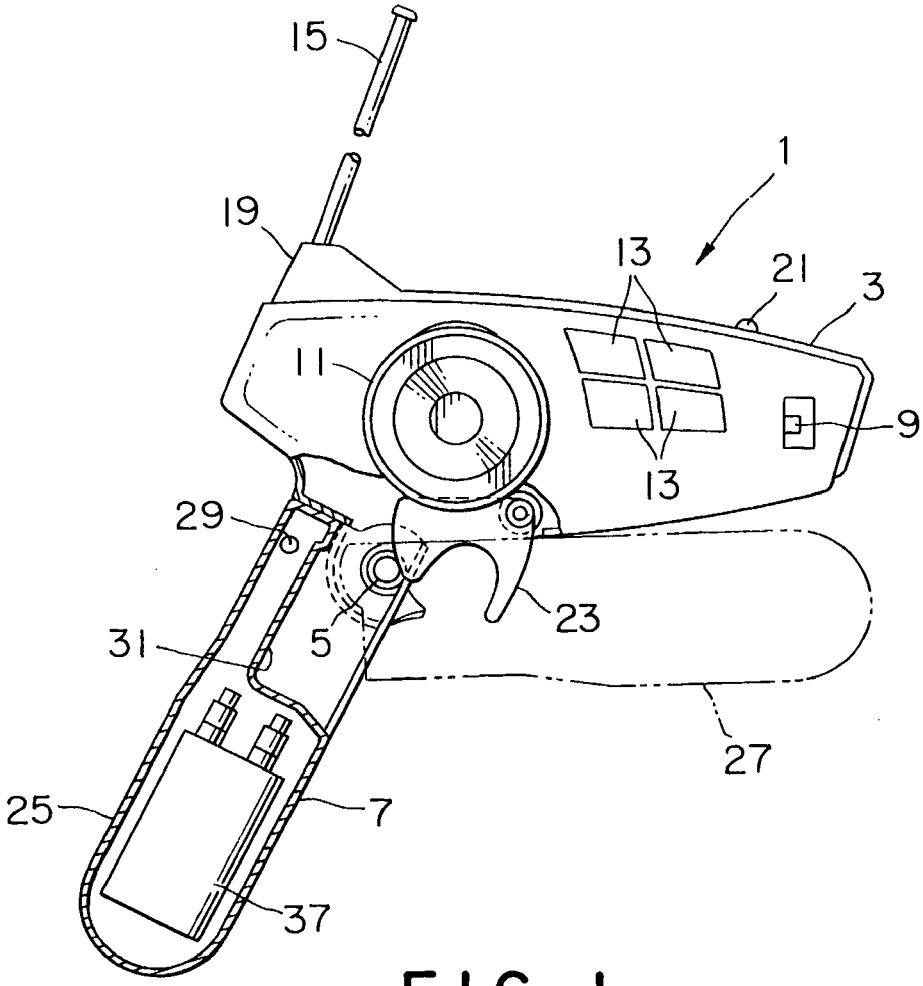
FIG. 1 is a partially-notched sectional view showing a gun grip controller in accordance with an embodiment of the present invention.
Figure 2:
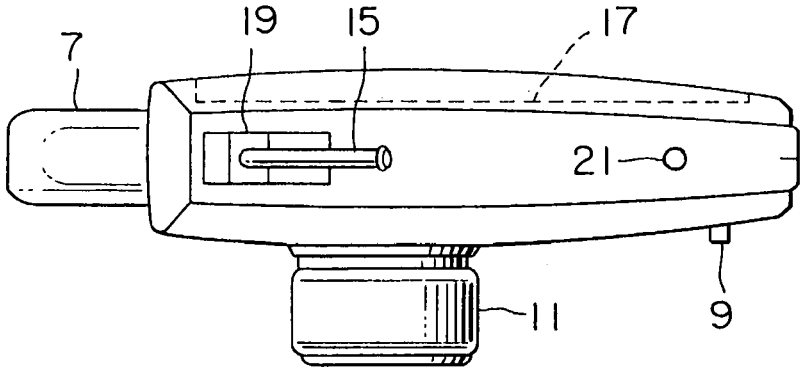
FIG. 2 is a top view of the gun grip controller of FIG. 1.
Figure 3:
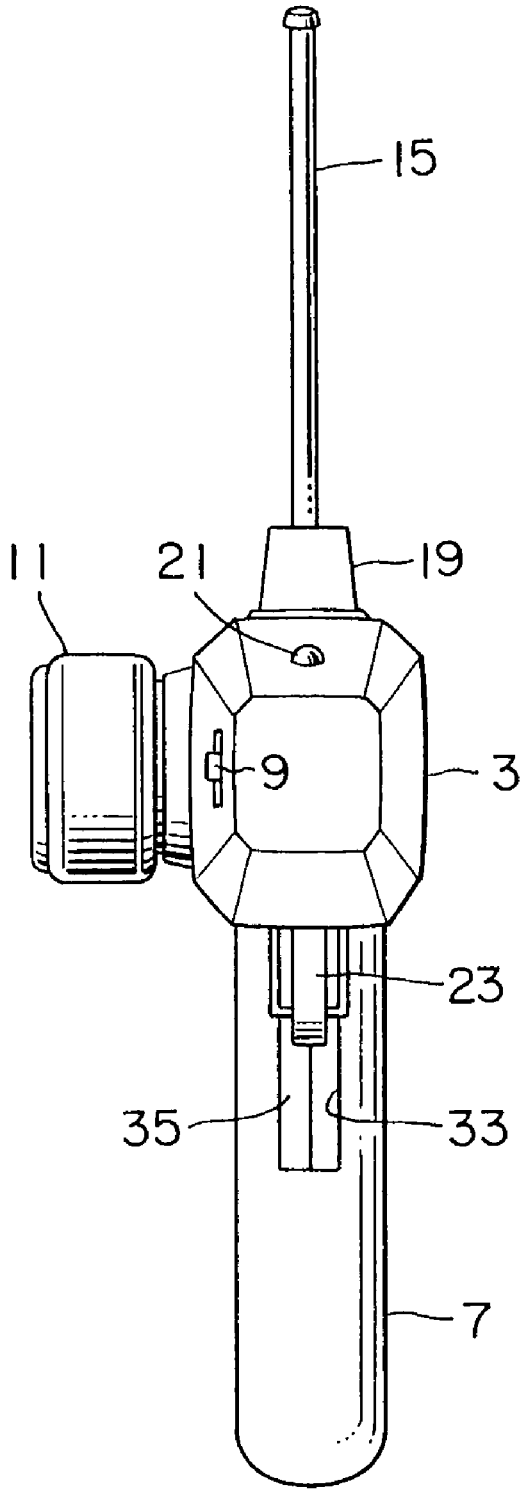
FIG. 3 is a side view of the gun grip controller of FIG. 1.

Referring to FIGS. 1 to 3, a gun grip controller in accordance with an embodiment of the present invention will be described below.

FIG. 1 shows a gun grip controller 1 of one embodiment of the present invention. This gun grip controller 1 includes a controller body 3 and a grip 7 provided to be rotatably attached to the controller body 3 about an axis (connection part) 5 as a rotation center. Corresponding to a pistol barrel in terms of shape, the controller body 3 is shaped as a rod and also provided, therein, with a transmitter (not shown) for controlling a model car etc., as an object to be controlled. On the right side of the controller body 3, there are arranged a power switch 9 of the gun grip controller 1, a steering dial 11 for manipulating a steering of the model car, other switches 13 and so on. Additionally, a transmittal rod antenna 15 is detachably arranged on the top of the controller body 3. At packing and carrying, this rod antenna 15 is accommodated in an antenna storage groove 17 formed on the left side of the controller body 3. In use, the antenna 15 is detached from the groove 17 and subsequently screwed into an antenna attaching part 19 on the top of the controller body 3. Further, the controller body 3 is provided, on the upper side which is downwardly sloped, with a power lamp 21.

A trigger-shaped lever 23 is arranged on the bottom of the controller body 3. Pulling the trigger-shaped lever 23 backward allows the model car to move forward, while pushing the trigger-shaped lever 23 forward allows the model car to move backward. The velocity of the car is increased as an amount of pulling or pushing is increased.

The grip 7 provided to the controller body 3 can occupy a protrusive position 25 where the grip 7 protrudes from the controller body 3 in substantially an L-shaped or T-shaped mannerand a folded position 27 where the grip 7 is folded along a longitudinal direction of the controller body 3. If the grip 7 is positioned at the protrusive position 25, then a ratchet mechanism (not shown) automatically operates to allow the grip 7 to be locked in the protrusive position 25. Further, the grip 7 is provided, at its top end, with an unlock button 29 for removing the grip 7 from a locked condition. Thus, pushing the unlock button 29 allows the grip 7 to be released from the locked condition, allowing it to be returned to the folded position.

Again, in the grip 7, a lever storage recess 31 is formed in order to accommodate the trigger-shaped lever 23 when the grip 7 is in the folded position. Referring to FIG. 3, the lever storage recess 31 is provided, at an opening 33, with a door 35 that is closed when the grip 7 is at the protrusive position 25 and that is open when the grip 7 is at the folded position 27 thereby allowing the trigger-shaped lever 23 to be accommodated. This door 35 is in the form of a double door and is usually urged to its closed position by springs or the like. This door 35 is forced to open when the trigger-shaped lever 23 is inserted into the lever storage recess 31. When the trigger-shaped lever is extracted out of the lever storage recess 31, the door 35 closes due to urging forces of the springs. When the grip 7 is at the protrusive position 25, this door 35 prevents dust etc. from entering an inside of the grip and also serves to improve an operator's gripping feeling. A battery is accommodated in the grip 7 and utilized for a power source of the controller.

The operation of the gun grip controller 1 will be described.

When the gun grip controller 1 is packed for carrying, the grip 7 is pivoted to the folded position 27. Then, the door 35 in the form of a double door is forced to open by the trigger-shaped lever 23 and it is accommodated in the lever storage recess 31. In this way, the positioning of the grip 7 in the folding position allows the size of the gun grip controller 1 as a whole to be reduced remarkably. Thus, with the reduction in package size of the controller, it is possible to facilitate its portability.

On the other hand, when using the gun grip controller 1, the grip 7 is raised by a pivotal movement. Then, when the trigger-shaped lever 23 retreats from the lever storage recess 31, the door 35 automatically closes due to the urging forces of the springs etc. Further, when bringing the grip 7 into the protrusive position, the ratchet mechanism operates automatically to fix the grip 7 in the protrusive position. In this way, by raising the grip 7 to the protrusive position in using the gun grip controller 1, the for gun grip controller 1 can be changed to a substantially T-shaped or L-shaped "gun grip" configuration, allowing an instant availability. Further, since the door 35 is automatically closed, it is possible to prevent an invasion of dust etc. and also possible to improve an operator's gripping feeling.

As mentioned above, this gun grip controller 1 includes the rod-shaped controller body 3 having the trigger-shaped lever 23, the steering dial 11, etc. for controlling a model car or the like and the grip 7 provided to protrude from the controller body 3. Moreover, the grip 7 is arranged so as to be rotatably attached to the controller body 3 and also adapted so as to allow an occupation of both the protrusive position 25 where the grip protrudes from the controller body 3 to a direction crossing the longitudinal direction of the controller body 3 and the folded position 27 where the grip 7 is folded to a direction along the longitudinal direction of the controller body 3. Accordingly, it is possible to decrease the size of the gun grip controller as a whole when packing and carrying the gun grip controller, in spite of its "gun-grip" configuration. This reduction in the package size of the gun grip controller 1 can be accomplished to facilitate its portability.

Again, the controller body 3 has the trigger-shaped lever 23 at a connection part of the controller body 3 with the grip 7, and the grip 7 is provided with the lever storage recess 31 for accommodating the trigger-shaped lever 23 when the grip 7 is at the folded position 27. Further, the lever storage recess 31 is provided, at the opening 33, with the door 35 in the form of a double door. The door 35 is arranged in its open position, to accommodate the trigger-shaped lever 23 when the grip 7 is at the folded position 27, and the door 35 is arranged in its closed position when the grip 7 is at the protrusive position 25. Therefore, when the grip 7 is at the folded position 27, the door 35 is forced to open by the trigger-shaped lever 23, so that the trigger-shaped lever 23 is accommodated in the lever storage recess 31. When the grip 7 is at the protrusive position 25 the trigger-shaped lever 23 retreats from the lever storage recess 31 and the door 35 automatically closes due to the urging forces of the springs etc. Therefore, it is possible to prevent dust etc. from invading into the recess and also possible to improve an operator's feeling in gripping the controller.

It is noted that the above-mentioned embodiment adopts a model car as the object to be controlled. Without being limited to the model car only, the invention is applicable to any object to be radio-controlled or remote-controlled. For example, the invention may be applied to controllers for models, such as airplane, ship, train and robot toys, other industrial equipment, vehicles, etc.

The invention claimed is:

1. A gun grip controller comprising:

a controller body having a manipulating part for controlling an object to be controlled, said controller body being substantially shaped like a rod; and a grip arranged to project from said controller body, wherein said grip is rotatably attached to said controller body at a connection part and is operable to occupy both a protrusive position, in which said grip protrudes from said controller body in a direction crossing a longitudinal direction of said controller body, and a folded position, in which said grip is positioned to extend along the longitudinal direction of said controller body so as to occupy a position adjacent to said controller body and outside of said controller body, wherein said controller body has a trigger-shaped manipulating part positioned at said connection part, wherein said grip comprises a storage recess arranged to accommodate said trigger-shaped manipulating part when said grip occupies the folded position, wherein said storage recess is provided, at an opening thereof, with a door movable between an open position and a closed position, wherein said grip, said door, and said trigger-shaped manipulating part are arranged such that, when said grip occupies the folded position, said door is in the open position and said storage recess accommodates said trigger-shaped manipulating part, and wherein said grip, said door, and said trigger-shaped manipulating part are arranged such that, when said grip occupies the protrusive position, said door is in the closed position.

2. The gun grip controller as claimed in claim 1, wherein said door is formed so as to be a double door.

3. The gun grip controller as claimed in claim 1, further comprising a rod antenna mounted on said controller body.

4. The gun grip controller as claimed in claim 3, wherein said controller body includes an antenna storage groove and an antenna attaching part, and said rod antenna is detachable from said antenna storage groove and attachable to said antenna attaching part.

5. The gun grip controller as claimed in claim 1, wherein said gun grip controller further comprises a power switch.

6. The gun grip controller as claimed in claim 1, wherein said controller body further comprises a steering dial operable to manipulate the object to be controlled.

7. The gun grip controller as claimed in claim 1, further comprising a power supply accommodated in said grip.

8. The gun grip controller as claimed in claim 7, wherein said power supply is a battery.

* * * * *